US009976349B2

(12) United States Patent
Altimas

(10) Patent No.: US 9,976,349 B2
(45) Date of Patent: May 22, 2018

(54) APPARATUS FOR PREVENTING SEPARATION OF DOWNHOLE MOTOR FROM DRILLSTRING

(71) Applicant: Weatherford/Lamb, Inc., Houston, TX (US)

(72) Inventor: Gregory Richard Altimas, Nisku (CA)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 637 days.

(21) Appl. No.: 14/021,901

(22) Filed: Sep. 9, 2013

(65) Prior Publication Data

US 2015/0068810 A1 Mar. 12, 2015

(51) Int. Cl.
*E21B 4/02* (2006.01)

(52) U.S. Cl.
CPC ..... *E21B 4/02* (2013.01); *Y10T 29/49012* (2015.01)

(58) Field of Classification Search
CPC ..... E21B 4/02; E21B 17/02; E21B 43/106; Y10T 29/49012
See application file for complete search history.

(56) References Cited

U.S. PATENT DOCUMENTS 5,149,143 A 9/1992 Howell
5,165,492 A 11/1992 Beasley
5,984,008 A * 11/1999 Lang ..... E21B 33/04 166/208
6,145,602 A 11/2000 Kutinsky
6,484,382 B1 * 11/2002 Smith ..... E21B 33/04 285/3
6,629,571 B1 10/2003 Downie
6,732,806 B2 * 5/2004 Mauldin ..... E21B 23/01 166/205
7,063,175 B1 6/2006 Kerstetter
7,445,061 B1 11/2008 Falgout, Sr. et al.
7,832,503 B2 11/2010 Sand et al.
(Continued)

FOREIGN PATENT DOCUMENTS

CA 2724161 A1 6/2012
WO 2013/074865 A1 5/2013

OTHER PUBLICATIONS

"eCTD Motor," Weatherford, obtained from weatherford.com, copyright 2006-2011, brochure No. 3955.05, 2 pages.
(Continued)

*Primary Examiner* — David J Bagnell
*Assistant Examiner* — Manuel C Portocarrero
(74) *Attorney, Agent, or Firm* — Blank Rome LLP

(57) ABSTRACT

A separation catch mechanism disposed above a power section of a motor prevents full separation of lower components of the motor from upper components and an attached drillstring. An extension of the mechanism has a first end coupled to the rotor and has a second end disposed in a housing member beyond a seat. An expandable shoulder, such as a washer, disposed on the second end of the extension can be expanded thereon to engage the seat should housing components separate from one another on the motor. To expand the washer after being inserted during assembly past the seat, the second end of the extension has a tapered head on which the washer is disposed. The outside diameter of the washer is expanded on the tapered head by tightening a nut against the washer.

28 Claims, 7 Drawing Sheets

(56) References Cited

U.S. PATENT DOCUMENTS

| | | | | |
|---|---|---|---|---|
| 8,025,110 | B2 | 9/2011 | Falgout, Jr. et al. | |
| 2004/0060706 | A1* | 4/2004 | Stephenson | E21B 17/042 166/380 |
| 2005/0200122 | A1* | 9/2005 | Mittersteiner | F16L 33/225 285/249 |
| 2010/0314172 | A1 | 12/2010 | Underwood et al. | |
| 2011/0240370 | A1 | 10/2011 | Shwets et al. | |
| 2012/0325561 | A1 | 12/2012 | LeBlanc et al. | |
| 2013/0075163 | A1 | 3/2013 | Harms | |

OTHER PUBLICATIONS

"HyperLine 250 Drilling Motor,"Weatherford, obtained from weatherford.com, copyright 2010-2011, brochure 7175.01, No. 3 pages.

Second Office Action in counterpart Canadian Appl. 2,861,809, dated Aug. 15, 2016, 3-pgs.

Extended European Search Report in counterpart EP Appl. 14184125, dated Dec. 8, 2016, 6-pgs.

First Office Action in counterpart Canadian Appl. 2,861,809, dated Nov. 30, 2015.

Patent Examination Report No. 1 in counterpart Australian Appl. 20142212899, dated Jul. 9, 2015.

* cited by examiner

APPARATUS FOR PREVENTING SEPARATION OF DOWNHOLE MOTOR FROM DRILLSTRING

BACKGROUND OF THE DISCLOSURE

Drilling assemblies have downhole motors and other mechanisms to achieve directional drilling. Referring to FIG. 1A, for example, a drilling assembly 10 connects to a drillstring 14 and has a drill bit 12 rotatably connected to a downhole motor 20. A rig 16 at the surface can rotate the drillstring 14 and the assembly 10, and surface equipment 18 including mud pumps can pump drilling fluid or mud down the drillstring 14 to the downhole motor 20. Operated by the flow of drilling fluid, the downhole motor 20 can also impart rotation to the drill bit 12.

In general, the downhole motor 20 as shown in FIGS. 1A-1B has a housing 22, a power section 24, a transmission section 26, and a bearing section 28. Drilling fluid pumped through the motor 20 actuates the power section 24, which drives a mandrel 29 through the transmission section 26 to rotate the drill bit (12). The bearing section 28 supports the motor's drive mandrel 29.

The environment encountered by the downhole motor 20 is extremely hostile. For example, the motor 20 is continuously exposed to very high temperatures over very long periods of time. Therefore, the bearing section 28 in the motor 20 may occasionally fail, which prevents the free rotation of the drive mandrel 29 relative to the motor housing 22. When this occurs, portions of the motor housing 22 below the power section 24 tend to rotate with the rotational force applied by the power section 24 to the drill bit 12.

Should the bearings in the bearing section 28 cease to operate properly, for example, then the rotational force applied to the drill bit 12 is also applied to the motor housing 22. Eventually, portions of the motor's housing 22 can separate from one another, and portions of the motor 20 can possibly become lost in the well. Typically, the portions of the housing 22 are attached with right hand threads. Therefore, the clockwise rotation of the portions of the housing 22 relative to one another tends to unscrew sections of the housing 22 until they separate.

A separation catch mechanism for preventing separation of a downhole motor from a drillstring has become standard equipment on motors used for directional drilling. One apparatus available in the art is disclosed in U.S. Pat. No. 5,165,492 by Dailey Petroleum Service Corp. Another apparatus is disclosed in U.S. Pat. No. 7,063,175 to Kerstetter.

As an example, FIG. 1B shows one type of apparatus for preventing separation of the downhole motor 20 from the drillstring. The motor 20 has an upper housing member 30 coupled to a lower housing member 40 above the power section 24. A rotor extension 60 is coupled to the end of the rotor 44, which is disposed for rotation in the stator 42 of the power section 24. Should portions of the motor's housing 22 separate during operation, a head 62 on the end of the extension 60 can engage a seat 35 in the upper housing member 30 and can prevent the lower housing member 40 and/or other portions of the motor 20 from separating completely from the upper housing member 30 and drillstring.

Yet another apparatus is used in Weatherford's Hyperline Drilling Motor. An example of this apparatus is illustrated in FIG. 2, which shows only an upper portion of a motor 20. Again, the motor 20 has an upper housing member 30 with a threaded end 34 coupled to a lower housing member 40.

An upper threaded end 36 of the upper member 30 can affix to other tubular members of the drillstring (not shown). The lower housing member 40 supports a stator 42 with a rotor 44 disposed for rotation therein. Flow of drilling fluid in the space between the rotor 44 and stator 42 rotates the rotor 44, which in turn rotates a drill bit (not shown) further downhole on the motor 20.

The upper member 30 has an internal passage 32 separated at its upper end from the upper threads 36 by a reduced passage 35. The internal passage 32 at its lower end has internal threads 38 to which a seat 50 threads. A rotor extension 60 threads at one end 64 to the rotor 44, and the other end of the rotor extension 60 has a head 62, which positions within the internal passage 32.

Assembly of the apparatus involves separately affixing the components of the housing members 30 and 40, the seat 50, and the rotor extension 60 so that the rotor extension 60 can be held within the upper housing member 30. Should some lower housing portions of the motor 20 separate from one another, then the head 62 on the distal end of the rotor extension 60 can engage the seat 50 and prevent the lower components of the motor 20 from fully separating from the upper motor components and the drillstring.

The separation catch mechanisms, such as discussed above, have performed adequately for many years. However, new developments in the power sections of motors and in the technology of drill bits have increased drilling rates by increasing the torque on the drill bit. These new developments have also been combined with changes to drilling practices, such as drilling both build and tangent sections of a borehole with a single motor bend setting (i.e., performing rotary drilling with significant bend in the motor). Under these conditions, the bending stiffness in the existing separation catch mechanisms may be imbalanced, which can result in connection fractures. In particular, the mechanism of FIG. 2 requires an excessively stiff pin end 34 due to the required step in the pin's internal dimension to accommodate the seat 50.

The subject matter of the present disclosure is directed to overcoming, or at least reducing the effects of, one or more of the problems set forth above.

SUMMARY OF THE DISCLOSURE

A downhole motor for a drillstring has a first housing member coupled to a second housing member. A rotor is disposed in the second housing member, and a seat is defined in the first housing member. To prevent full separation of lower components of the motor from upper components and the attached drillstring, the motor has a separation catch mechanism disposed above the power section of the motor. An extension has a first end coupled to the rotor and has a second end disposed in the first housing member beyond the seat. An expandable shoulder disposed on the second end of the extension is expanded thereon to engage the seat should housing components separate from one another.

In one alternative, the expandable shoulder can be a washer disposed on the second end of the extension. To expand the washer after being inserted during assembly past the seat, the second end of the extension has a tapered head on which the washer is disposed. The outside diameter of the washer is expanded on the tapered head after insertion in the first housing member past the seat by tightening a nut on the second end of the extension to expand the washer.

In another alternative, the expandable shoulder can have a plurality of segments disposed on the second end of the extension. The segments can move along a tapered head of the extension or may be disposed on a separate conical ring positioned on the extension. The segments can be held by an arrangement of tongues and grooves.

Assembly of the drilling motor with the separation catch mechanism involves positioning the expandable shoulder on the first end of the extension and holding the expandable shoulder on the extension's first end with a hand-tightened nut. The first end, the expandable shoulder, and the nut are inserted past the seat in the first housing member of the motor. At this point, the expandable shoulder is expanded on the first end to be engageable with the seat by tightening the nut on the tapered head of the extension's first end. Finally, a second end of the extension attaches to the rotor, and the various housing components of the motor are assembled. Should the housing components of the motor separate during drilling, the expandable shoulder can engage the seat to limit the displacement of the rotor and any associated motor components.

The foregoing summary is not intended to summarize each potential embodiment or every aspect of the present disclosure.

DETAILED DESCRIPTION OF THE DISCLOSURE

Figure 1A:
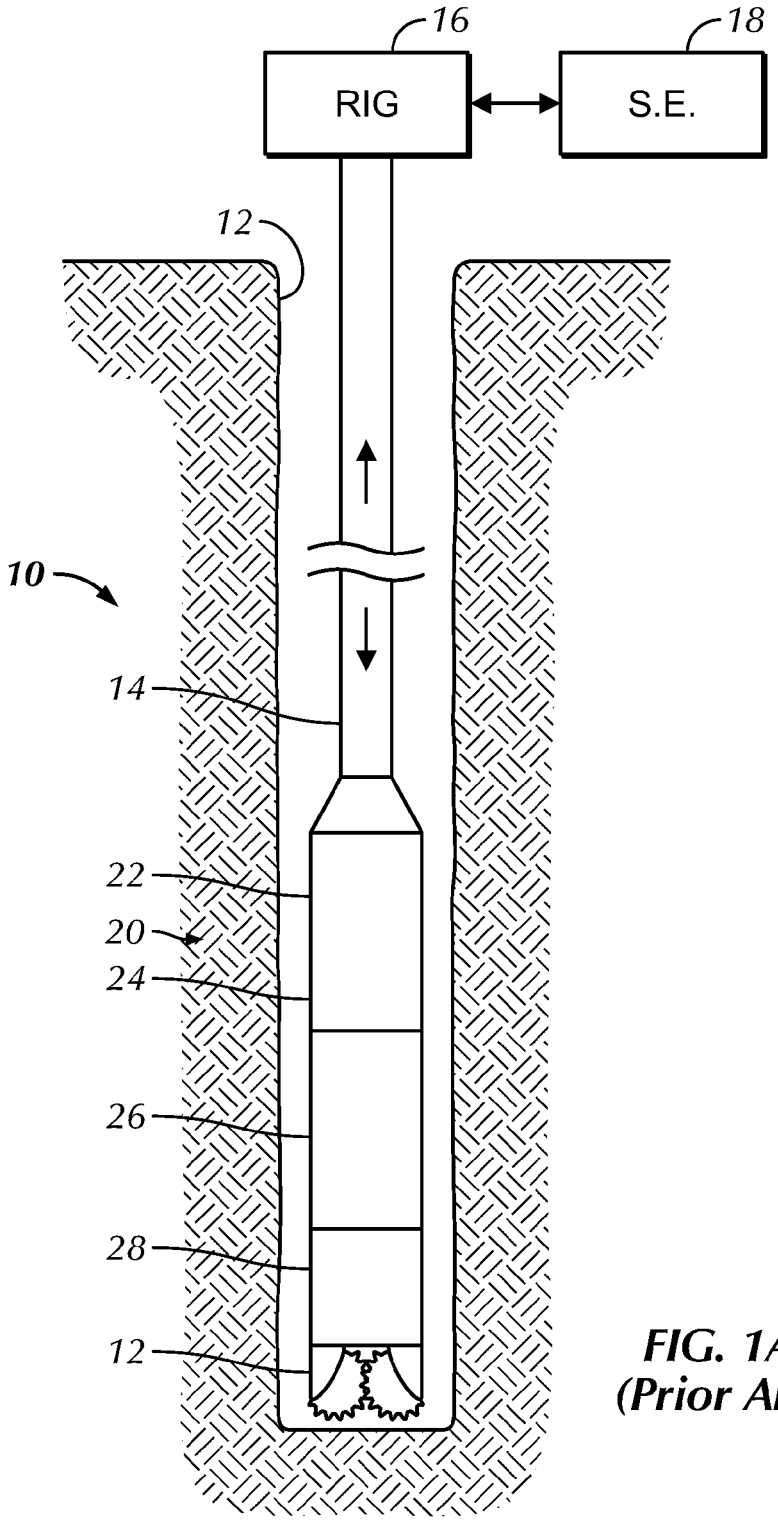
FIG. 1A (Prior Art)
FIG. 1A illustrates a drilling assembly disposed on a drillstring and having a downhole motor and a drill bit.
Figure 1B:
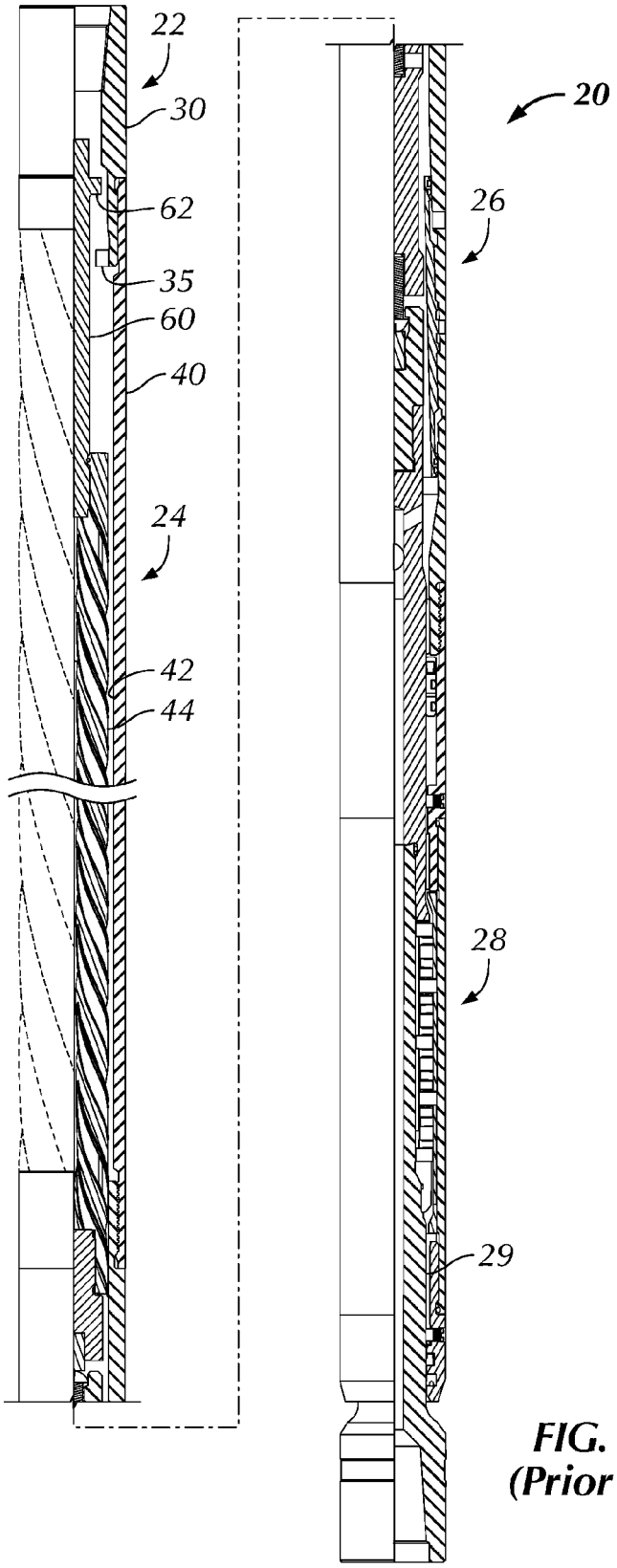
FIG. 1B (Prior Art)
FIG. 1B illustrates a downhole motor in partial cross-section having one type of separation catch mechanism according to the prior art.
Figure 2:
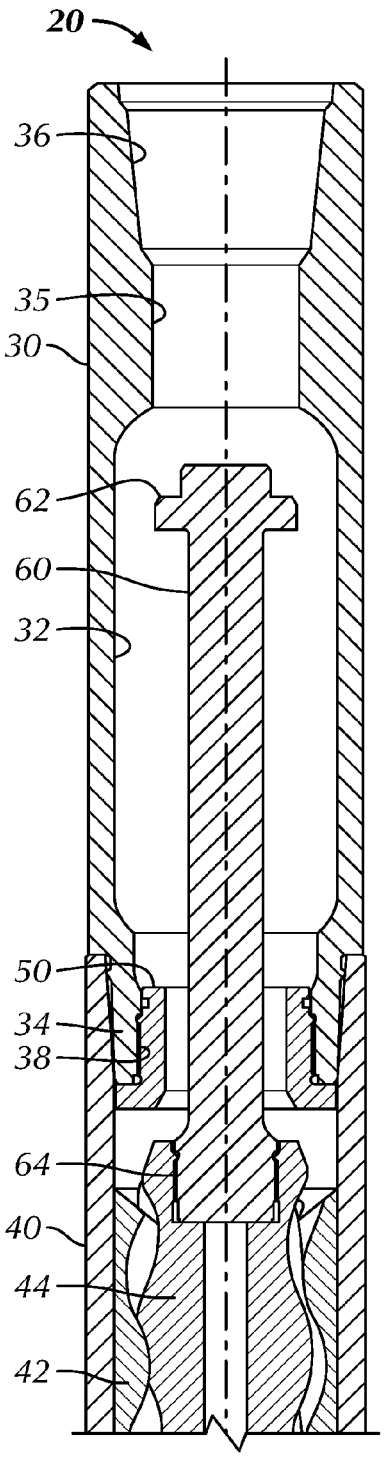
FIG. 2 (Prior Art)
FIG. 2 illustrates another type of separation catch mechanism according to the prior art on the end of a rotor between upper and lower housing members of a motor.
Figure 3:
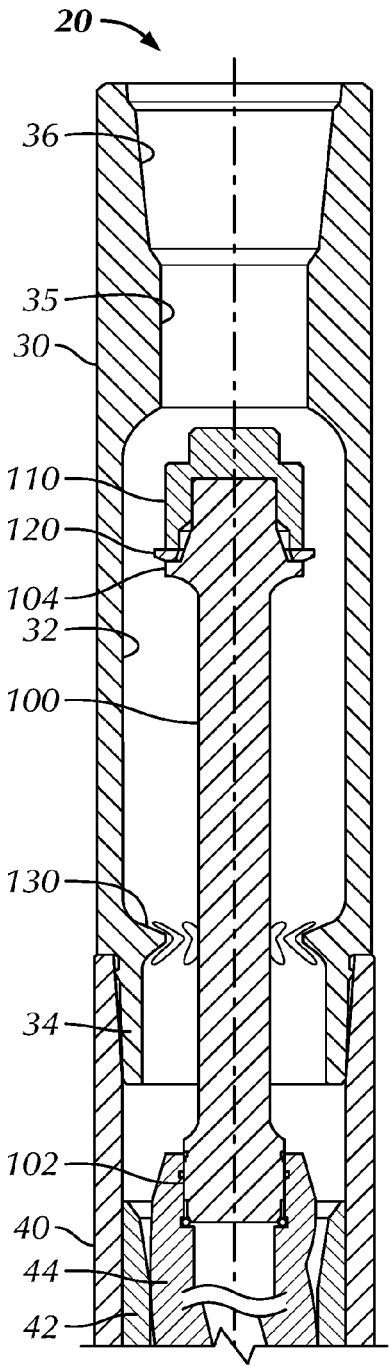
FIG. 3 illustrates a separation catch mechanism according to the present disclosure on the end of a rotor between upper and lower housing members of a motor.

As noted above, portions of a downhole motor can separate for a number of reasons during operation, such as when bearings in a bearing section of the motor fail. To deal with this potential separation, a separation catch mechanism is used on a drilling motor 20 as shown in FIG. 3, which illustrates only portion of the downhole motor 20.

An upper housing member 30 has a threaded pin end 34 that threads to a lower housing member 40 of the motor 20. An upper threaded box end 36 of the upper member 30 can affix to other tubular members of the drillstring (not shown). The lower member 40 supports a stator 42 with a rotor 44 disposed for rotation therein as part of the motor's power section. Although not shown, the motor 20 has other conventional components, such as a transmission section, bearing section, drive mandrel, etc.

During normal operation, the housing members 30 and 40 remain joined together to form a substantially unitary construction with a drilling fluid passage formed in the core thereof. Drilling fluid flows past the joint formed at the junction of the housing members 30 and 40. The flow of drilling fluid enters in the space between the stator 44 and the rotor 42, which rotates in the stator 44 and in turn rotates a drill bit (not shown).

The upper member 30 has an internal passage 32 separated at its upper end from the upper box end 36 by a reduced passage 35. The internal passage 32 at its lower end has a seat 130 formed therein. As shown, the seat 130 is a shoulder that can have a plurality of slots, spaces, or gaps therebetween for potential fluid passage. Rather than being integrally formed, the seat 130 may comprise a separate flange, landing shoulder, or the like that fixedly installs inside the internal passage 32 in any number of suitable ways.

Figure 4A:
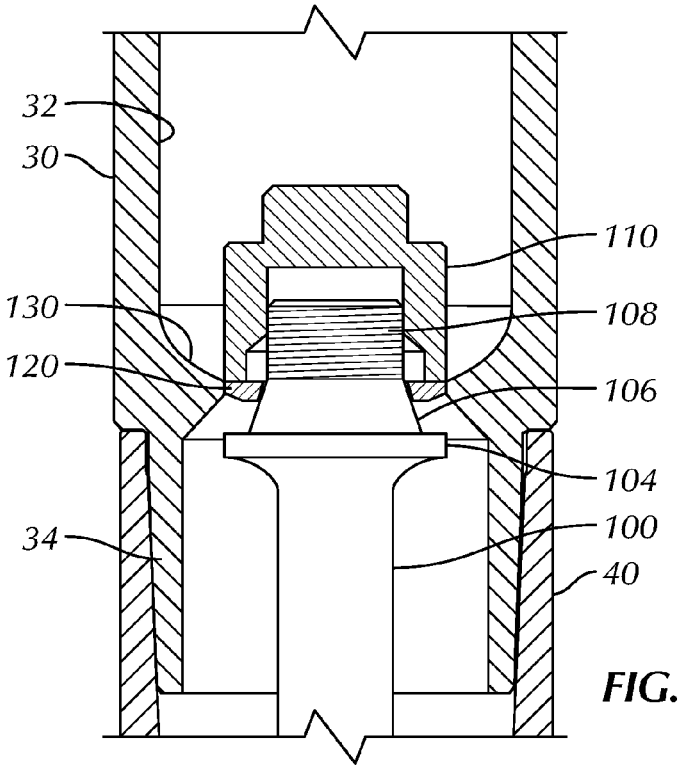
FIG. 4A shows insertion of the disclosed separation catch mechanism during assembly.
Figure 4B:
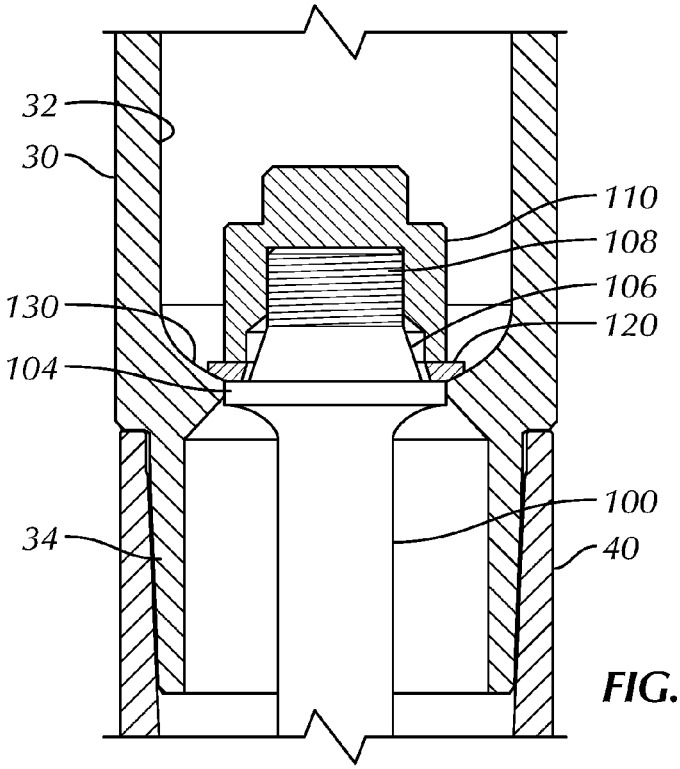
FIG. 4B shows engagement of the disclosed separation catch mechanism during separation of the motor's housing members.

A rotor extension 100 threads at one end 102 to the rotor 42. As best shown in FIGS. 4A-4B, the other end of the rotor extension 100 has a ledge 104, a conical surface or tapered head 106, and a threaded end 108, which position within the internal passage 32. An expandable shoulder 120, such as a washer, ring, or the like, is disposed on the tapered head 106 against the extension's ledge 104. A nut 110 tightened on the extension's threaded end 108 expands the shoulder 120 outward on the tapered head 106 and holds the shoulder 120 against the ledge 104.

As can be seen, the pin end 34 of the upper member 30 does not require internal threading to receive a seat as in the prior art. As additional differences, the top end of the rotor extension 100 includes the tapered head 106 and threaded end 108. The expandable shoulder 120 is inserted on the tapered head 106, and the nut 110 is threaded on the threaded end 108 to expand the expandable shoulder 120 against the ledge 104.

Assembly of the catch mechanism involves assembling the expandable shoulder 120 on the tapered head 106 and threading the nut 110 hand-tight on the end 108 of the rotor extension 100. With the nut 110 threaded only hand-tight, the shoulder's outside diameter is smaller than the internal diameter of the seat 130 toward the pin end 34 on the upper member 30. In this way, the end of the rotor extension 100 can insert into the upper housing member 30. FIG. 4A shows insertion of the rotor extension 100 during this stage of assembly.

A long wrench tool (not shown) is inserted through the box end 36 on the upper member 30 to engage the nut 110. Using a pipe wrench or the like, the exposed end of the rotor extension 100 is gripped, and the nut 110 is tightened on the threaded end 108 to a specified torque. During tightening, the expandable shoulder 120 is pushed onto the tapered head 106, which increases the shoulder's outside diameter. At the torqued state, the expandable shoulder's outside diameter is bigger than the inside diameter of the seat 130. The expansion process can be controlled through the use of geometric features, such as grooves, slots, scores or the like, to separate the expandable shoulder 120 into a plurality of wedges, petals, or other shapes.

The rest of the downhole motor 20 can be assembled, and the assembly can be used downhole in a drilling operation. As noted above, clockwise rotation of the motor's housing components has a tendency to unscrew conventional right hand threads using to connect components of the motor 20 together. Thus, to prevent the rotor extension 100 from being unscrewed from and separating from the downhole motor 20, left hand threads can be employed on the threaded portions of the rotor extension 100.

If rotation of the lower member 40 unscrews it from the upper member 30 or if some other motor housing components unscrew from one another, a longitudinal displacement occurs. Because the rotor extension 100 is connected to the rotor 44, this longitudinal displacement moves the rotor extension 100 to a seated position and can discontinue operation of the downhole motor 20.

In particular, should housing components separate on the motor 20, then the expandable shoulder 120 on the distal end of the rotor extension 100 can engage the seat 130 and prevent the lower components of the motor 20 from fully separating from the upper components and the drillstring. FIG. 4B shows engagement of the expandable shoulder 120 of the catch mechanism against the seat 130 during displacement of the rotor extension 100 and separation of the motor components.

The separation catch mechanism minimizes changes to the stiffness at the pin end 34 of the upper housing member 30. This allows the bending stiffness between the pin end 34 and the box end 36 to be optimized. Having the pin end 34 with flexibility relative to the box end 36 can be beneficial in dealing with current challenges in motors (e.g., increased drilling rates, increased torque on the drill bit, drilling both build sections and tangent sections with a single motor bend setting, etc.).

Figure 5:
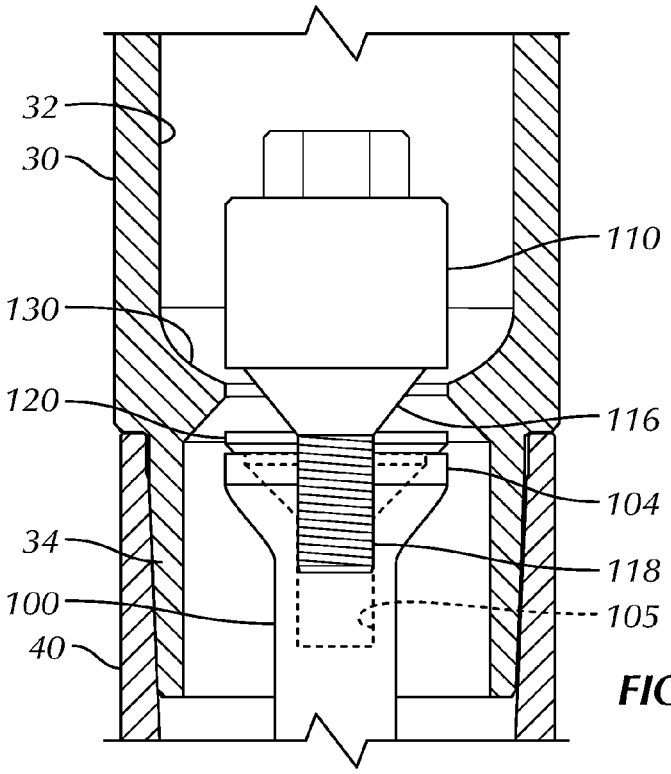
FIG. 5 illustrates another separation catch mechanism according to the present disclosure.

Although the end of the rotor extension 100 has been described above as having a ledge 104, a tapered head 106, and a threaded end 108 on which a nut 110 threads, a reverse arrangement could be used. Turning to FIG. 5, another separation catch mechanism according to the present disclosure is illustrated. The end of the rotor extension 100 has a threaded socket 105 with the ledge 104 disposed therearound. The nut 110 has an inverted tapered head 116 with a threaded bolt end 118 extending therefrom. With the expandable shoulder 120 disposed on the tapered head 116 of the nut 110, the threaded bolt end 118 can thread in the socket 105 inside the ledge 104 of the rotor extension 110 so that the tapered head 116 expands the expandable shoulder 120 against the ledge 104.

Figure 6:
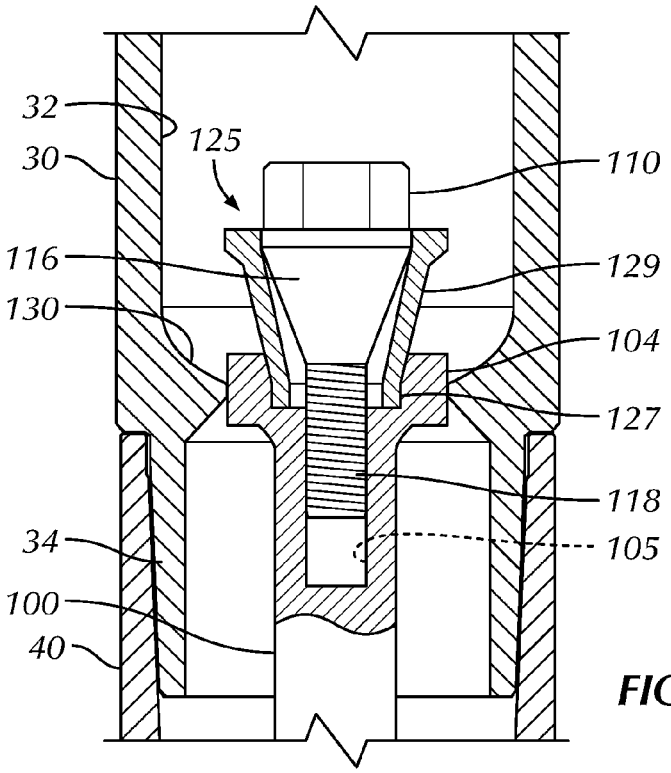
FIG. 6 illustrates yet another separation catch mechanism according to the present disclosure.

Turning to FIG. 6, yet another separation catch mechanism according to the present disclosure is illustrated. Again, the end of the rotor extension 100 has a threaded socket 105 with the ledge 104 disposed therearound. The nut 110 has an inverted tapered head 116 with a threaded bolt end 118 extending therefrom. The expandable shoulder 125 in this mechanism is a collet having fingers 129 extending from a base ring 127. The fingers 129 can be expanded outward beyond the ledge 104 when the nut 110 is tightened on the rotor extension 100. In particular, with the collet 125 disposed on the tapered head 116, the threaded bolt end 118 can thread in the socket 105 inside the ledge 104 of the rotor extension 110, and the fingers 129 of the collet 125 can expand outward. A reverse arrangement is also possible.

Figure 7A:
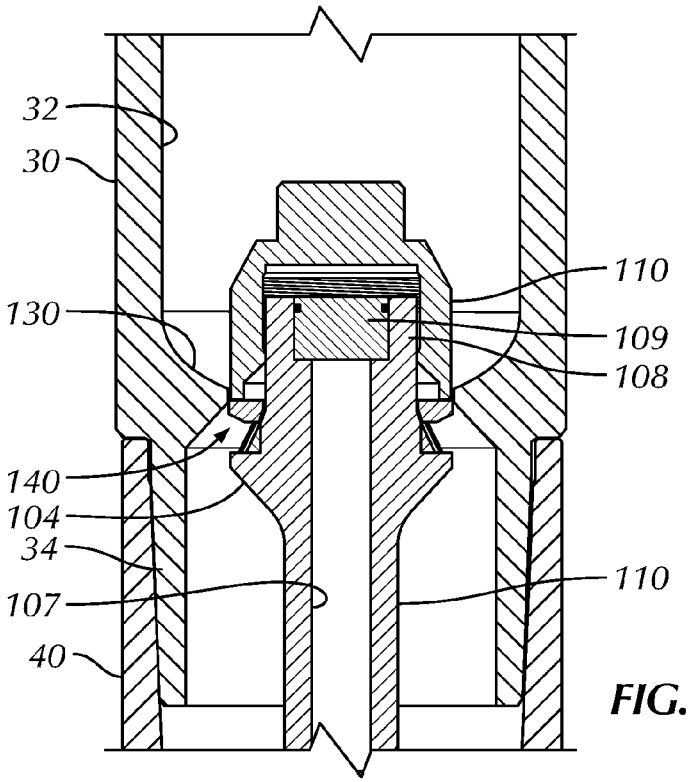
FIGS. 7A-7B illustrate another separation catch mechanism according to the present disclosure in unset and set conditions.
Figure 7B:
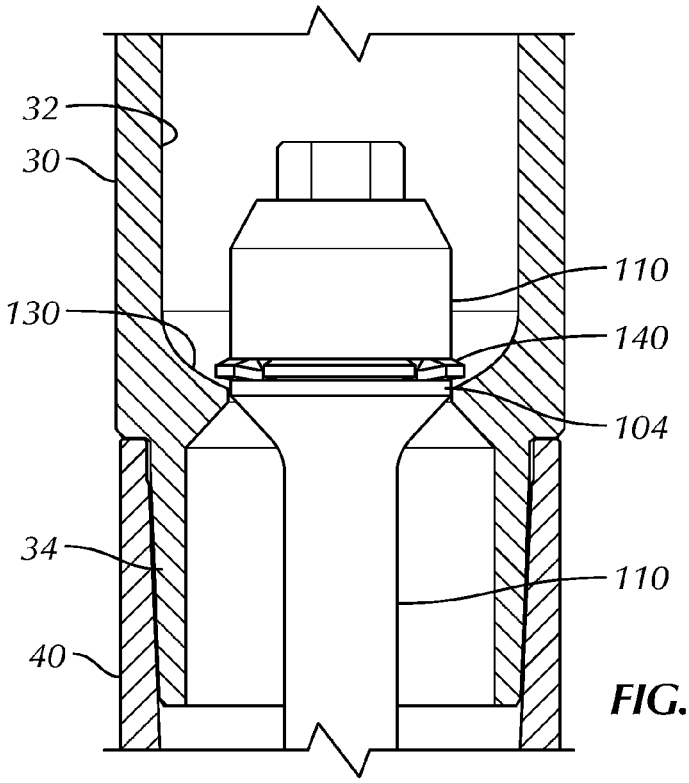

Turning to FIGS. 7A-7B, another separation catch mechanism according to the present disclosure is shown in unset and set conditions, respectively. As before, the rotor extension 100 threads to the rotor (not shown), and the other end of the rotor extension 100 has a ledge 104 and a threaded end 108, which position within the internal passage 32 of the upper member 30. An expandable shoulder 140 is disposed on the threaded end 108 against the extension's ledge 104. A nut 110 tightens on the extension's threaded end 108 to expand the expandable shoulder 140 and hold it in place against the ledge 104.

In this example, the rotor extension 100 defines a through-bore 107 all the way through, which allows the extension 100 to be used for various purposes such as fluid communication through a nozzle or the like. In the present example, a seal element 109 can be disposed in the through-bore 107 at the nut 110 for sealing purposes.

Figure 8A:
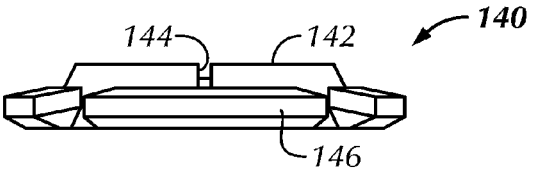
FIGS. 8A-8C illustrate an expandable shoulder of the separation catch mechanism in side, top (expanded), and bottom (expanded) views.

Assembly of the catch mechanism involves assembling the expandable shoulder 140 on the rotor extension 100 and threading the nut 110 hand-tight on the threaded end 108 of the rotor extension 100. With the nut 110 threaded only hand-tight, the outside diameter of the expandable shoulder 140 is smaller than the internal diameter of the seat 130. In this way, the end of the rotor extension 100 with the shoulder 140 unexpanded can insert into the upper housing member 30. FIG. 8A shows insertion of the rotor extension 100 during this stage of assembly.

A long wrench tool (not shown) is inserted through the upper member 30 to engage the nut 110. Using a pipe wrench or the like, the exposed end of the rotor extension 100 is gripped, and the nut 110 is tightened on the threaded end 108 to a specified torque. During tightening, the expandable shoulder 140 expands outward increasing its outside diameter. At the torqued state best shown in FIG. 8B, the expandable shoulder 140 has an outside diameter that is greater than the inside diameter of the seat 130.

As noted above in previous embodiments, expansion of an expandable shoulder disclosed herein can occur by permanent deformation (as in the case of a washer or ring in FIG. 3) or by elastic deformation (as in the case of a collet with fingers in FIG. 6). In the embodiment of FIGS. 7A-7B, by contrast, the expandable shoulder 140 has a plurality of segments expanded on a conical ring when the nut 110 is threaded on the rotor extension 110.

Figure 8C:
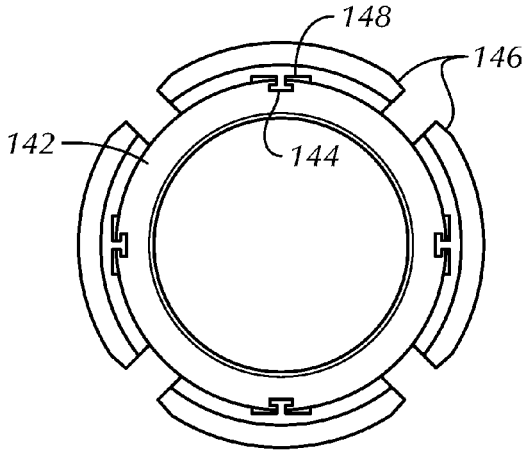
Figure 8B:
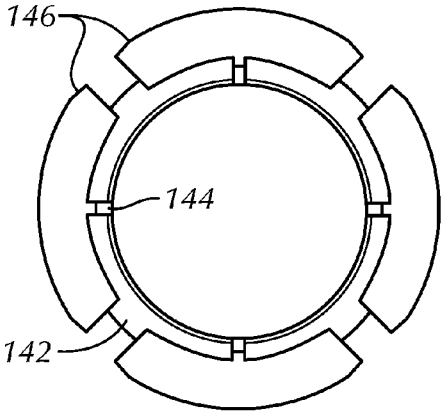

FIGS. 8A-8C illustrate an example of this segmented expandable shoulder 140 in a side view (FIG. 8A), a top (expanded) view (FIG. 8B), and a bottom (expanded) view (FIG. 8C). The expandable shoulder 140 has a plurality of segments 146 that can be expanded on a central conical ring 142. When positioned toward the top of the conical ring 142, the segments 146 come together and produce a reduced diameter. When positioned toward the bottom of the conical ring 142 as when the nut (110) is threaded on the rotor extension (100), the segments 146 move apart to produce an increased diameter, as shown in FIGS. 8A-8C.

The segments 146 can be connected to the conical ring 142 using tongue and groove arrangements or other types of arrangements. For example, the segments 146 can have tongues 148 that slideably dispose in grooves 144 defined around the conical ring 142. As the segments 146 move up or down on the conical ring 142, the tongues 148 are guided in the grooves 144. As shown, the tongues 148 may have a T-shape or other geometry to hold the segments 146 laterally on the conical ring 142. A reverse arrangement could also be used where the segments 146 have grooves that ride along outward projecting tongues on the conical ring 142.

Alternative arrangements of an expandable shoulder 140 with a plurality of segments 146 can also be used. For example, the end of the rotor extension (110) may have a conical surface or head (e.g., 106) as in previous embodiments, and the segments 146 may dispose on the integral conical surface of the rotor extension (110). A tongue and groove arrangement may also be used in this configuration.

In an another alternative, the nut 110 can have a conical surface and can have a bolt end similar to the nut 110 in FIG.

5. In this instance, such a nut 110 may thread in a threaded opening of the rotor extension 100 to expand the segments 146 of the expandable shoulder 140.

Figure 9B:
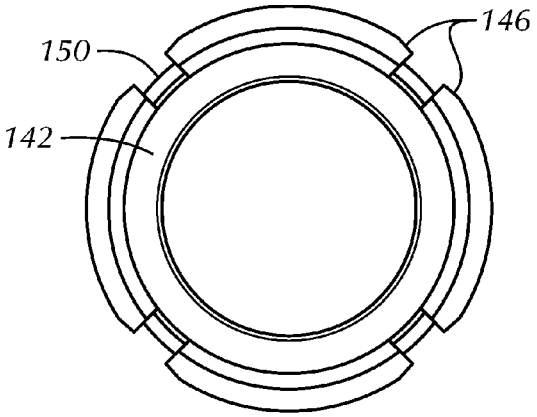
FIGS. 9A-9B illustrate another expandable shoulder of the separation catch mechanism in top (expanded) and bottom (expanded) views.
Figure 9A:
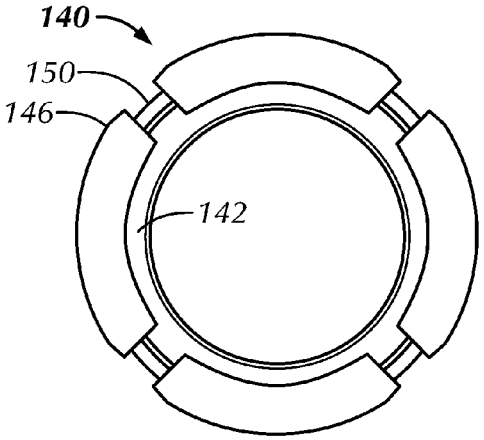

As another example shown in FIGS. 9A-9B, the conical ring 142 may be a separate component as before, although the end of the rotor extension (110) may have a conical surface or head (e.g., 106) as in previous embodiments. Rather than being held by a tongue and groove arrangement, the segments 146 for this embodiment may be held together by an expandable ring 150 affixed around the segments 146. In other arrangements, the segments 146 can be held together by interconnected ends between the segments 146 or by other features. As will be appreciated, the purpose of the expandable ring 150, tongue and groove arrangement, or other comparable features is to facilitate assembly and disassembly of the mechanism. During use of the expandable shoulder 140, the segments 146 are primarily held in place by being sandwiched between the tightened nut (110) and the extension's ledge (104).

The foregoing description of preferred and other embodiments is not intended to limit or restrict the scope or applicability of the inventive concepts conceived of by the Applicants. As will be appreciated with the present disclosure, for example, the expandable shoulder (which is expanded on the rotor extension 100 to engage the housing's seat 130 if the rotor is displaced) can have a number of configurations. In general, the expandable shoulder can include a washer, a bevel washer, a collet with fingers, a conical shaped spacer, a plurality of wedge shaped segments, and other structures. The expandable shoulder can be expanded through a variety of means, such as a plurality wedge segments guided on tongues and grooves or the like. Alternatively, the expansion can occur by elastic deformation as in the case of a collet with fingers or by permanent deformation as in the case of a washer. The expansion process can be controlled through the use of geometric features such as grooves to separate the expanded shoulder into a plurality of wedges. Alternatively, grooves or another type of geometry in a seat can allow the retrieval of an expanded shoulder.

Moreover, although the present disclosure has disclosed that the separation catch mechanism is coupled to the rotor of a downhole motor's power section, it will be appreciated that the separation catch mechanism can be used above another type of downhole apparatus having a rotatable mandrel disposed in an outer housing.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole motor for a drillstring, the motor comprising:

a housing having upper and lower portions coupled to one another;

a rotor disposed in the lower portion;

a seat disposed in the upper portion, the seat having a lower side toward the lower portion and having an upper side toward the upper portion;

an extension having a first end coupled to the rotor in the lower portion and having a second end disposed in the upper portion beyond the upper side of the seat; and an expandable shoulder disposed on the second end of the extension and being expandable on the second end at least from an unexpanded state to an expanded state, the expandable shoulder in the unexpanded state on the extension being passable through the seat at least from the lower side to the upper side, the expandable shoulder in the expanded state on the extension being engageable with at least the upper side of the seat in response to separation of the upper and lower portions of the housing from one another, wherein the expandable shoulder comprises a washer disposed on the second end of the extension, and wherein the second end of the extension comprises a conical surface on which the washer is disposed, the washer expanded on the conical surface after insertion of the second end of the extension past the seat and into the upper portion of the housing.

2. The motor of claim 1, wherein the second end of the extension comprises a nut threaded thereon and tightened to expand the washer on the conical surface.

3. The motor of claim 2, wherein the nut threaded on the second end of the extension comprises the conical surface on which the washer is expanded.

4. The motor of claim 1, wherein the first end of the extension threads onto the rotor.

5. The motor of claim 1, wherein the seat comprises a shoulder disposed around an inside of the upper portion of the housing.

6. The motor of claim 5, wherein the shoulder defines a plurality of slots therein.

7. The motor of claim 1, wherein the washer of the expandable shoulder comprises a plurality of segments disposed on the second end of the extension.

8. The motor of claim 7, wherein the conical surface on which the washer of the expandable shoulder is disposed comprises a conical ring disposed on the second end of the extension and having the segments arranged thereabout.

9. The motor of claim 8, wherein the segments and the conical ring comprises an arrangement of tongues and grooves holding the segments on the conical ring.

10. An assembly for a downhole apparatus having a rotatable mandrel disposed in an outer housing, the assembly comprising:

an upper housing coupled to the outer housing;

a seat disposed in the upper housing, the seat having a lower side toward the outer housing and having an upper side toward the upper housing;

an extension having a first end coupled to the rotatable mandrel in the outer housing and having a second end disposed in the upper housing beyond the upper side of the seat; and an expandable shoulder disposed on the second end of the extension and being expandable on the second end at least from an unexpanded state to an expanded state, the expandable shoulder in the unexpanded state on the extension being passable through the seat at least from the lower side to the upper side, the expandable shoulder in the expanded state on the extension being engageable with at least the upper side of the seat in response to displacement of the extension, wherein the expandable shoulder comprises a washer disposed on the second end of the extension, and wherein the second end of the extension comprises a conical surface on which the washer is disposed, the washer expanded on the conical surface after insertion of the second end of the extension past the seat and into the upper housing.

11. The assembly of claim 10, wherein the second end of the extension comprises a nut threaded thereon and tightened to expand the washer on the conical surface.

12. The apparatus of claim 11, wherein the nut threaded on the second end of the extension comprises the conical surface on which the washer is expanded.

13. The assembly of claim 10, wherein the upper housing threads to the outer housing.

14. The assembly of claim 10, wherein the first end of the extension threads onto the mandrel.

15. The assembly of claim 10, wherein the seat comprises a shoulder disposed around an inside of the upper housing.

16. The assembly of claim 15, wherein the shoulder defines a plurality of slots therein.

17. The assembly of claim 10, wherein the washer of the expandable shoulder comprises a plurality of segments disposed on the second end of the extension.

18. The assembly of claim 17, wherein the conical surface on which the washer of the expandable shoulder is disposed comprises a conical ring disposed on the second end of the extension and having the segments arranged thereabout.

19. The assembly of claim 18, wherein the segments and the conical ring comprise an arrangement of tongues and grooves holding the segments on the conical ring.

20. A method of assembling a drilling motor, comprising:

positioning an expandable shoulder on an upper end of an extension for a rotor of the drilling motor, the expandable shoulder being expandable on the upper end at least from an unexpanded state to an expanded state;

holding the expandable shoulder in the unexpanded state on the upper end with a nut;

inserting the upper end of the extension, the unexpanded expandable shoulder, and the nut past a seat in an upper housing portion of the motor; and expanding the expandable shoulder to the expanded state on the upper end of the extension to be engageable with at least an upper side of the seat in response to displacement of the extension by plastically deforming a ring on a conical surface by tightening the nut on the upper end of the extension.

21. The method of claim 20, further comprising attaching a lower end of the extension to the rotor.

22. The method of claim 20, further comprising attaching the upper housing portion of the motor to a lower housing portion of the motor having the rotor disposed therein.

23. A method of assembling a drilling motor, comprising:

positioning an expandable shoulder on an upper end of an extension for a rotor of the drilling motor, the expandable shoulder being expandable on the upper end at least from an unexpanded state to an expanded state;

holding the expandable shoulder in the unexpanded state on the upper end with a nut;

inserting the upper end of the extension, the unexpanded expandable shoulder, and the nut past a seat in an upper housing portion of the motor; and expanding the expandable shoulder to the expanded state on the upper end of the extension to be engageable with at least an upper side of the seat in response to displacement of the extension by elastically deforming a collet by tightening the nut on the upper end of the extension.

24. The method of claim 23, further comprising attaching a lower end of the extension to the rotor.

25. The method of claim 23, further comprising attaching the upper housing portion of the motor to a lower housing portion of the motor having the rotor disposed therein.

26. A method of assembling a drilling motor, comprising:

positioning an expandable shoulder on an upper end of an extension for a rotor of the drilling motor, the expandable shoulder being expandable on the upper end at least from an unexpanded state to an expanded state;

holding the expandable shoulder in the unexpanded state on the upper end with a nut;

inserting the upper end of the extension, the unexpanded expandable shoulder, and the nut past a seat in an upper housing portion of the motor; and expanding the expandable shoulder to the expanded state on the upper end of the extension to be engageable with at least an upper side of the seat in response to displacement of the extension by expanding a plurality of segments outward by tightening the nut on the upper end of the extension.

27. The method of claim 26, further comprising attaching a lower end of the extension to the rotor.

28. The method of claim 26, further comprising attaching the upper housing portion of the motor to a lower housing portion of the motor having the rotor disposed therein.

* * * * *